United States Patent [19]

Wedge et al.

[11] Patent Number: 4,944,674

[45] Date of Patent: Jul. 31, 1990

[54] APPARATUS FOR HEATING A VESSEL

[75] Inventors: Philip J. Wedge, Solihull; David Wharmby, Birmingham, both of England

[73] Assignee: British Gas plc, London, England

[21] Appl. No.: 434,782

[22] Filed: Nov. 13, 1989

[51] Int. Cl.[5] ..... F27B 14/00

[52] U.S. Cl. ..... 432/158; 432/156; 432/54; 431/170

[58] Field of Search ..... 432/54, 156, 157, 158, 432/210; 431/7, 170

[56] References Cited

U.S. PATENT DOCUMENTS

| | | | |
|---|---|---|---|
| 4,455,016 | 6/1984 | Urdea | 432/158 |
| 4,604,051 | 8/1986 | Davies et al. | 431/170 |
| 4,676,744 | 6/1987 | Wray et al. | 431/170 |

FOREIGN PATENT DOCUMENTS

| | | |
|---|---|---|
| WO83/00735 | 3/1983 | PCT Int'l Appl. . |
| WO86/05865 | 10/1986 | PCT Int'l Appl. . |
| 333192 | 8/1930 | United Kingdom . |
| 842024 | 7/1960 | United Kingdom . |
| 1017754 | 1/1966 | United Kingdom . |
| 1071926 | 6/1967 | United Kingdom . |
| 2128724 | 5/1984 | United Kingdom . |
| 2195011 | 3/1988 | United Kingdom . |

*Primary Examiner*—Carroll B. Dority

*Attorney, Agent, or Firm*—Oblon, Spivak, McClelland, Maier & Neustadt

[57] ABSTRACT

An apparatus such as a crucible furnace for heating a vessel such as a crucible comprises an enclosure surrounding the vessel so that a flow path exists between the enclosure and the vessel which has an outer surface forming the inner boundary of the flow path. The flow path extends all around the vessel. First and second gas fired burners open into the flow path to discharge their hot combustion product gases into the path. Associated with each burner is a respective heat regenerator. When the first burner is in firing mode its emitted hot combustion product gases circulate around the flow path and leave through the second burner, which is in flueing mode, and heat the associated regenerator. Then when the second burner is in firing mode that heated regenerator heats the combustion air used by the second burner. The hot combustion product gases emitted by the second burner flow along the flow path but this time in the opposite direction and leave through the first burner, which is in flueing mode, and heat its associated regenerator.

14 Claims, 3 Drawing Sheets

APPARATUS FOR HEATING A VESSEL

This invention relates to apparatus for heating a vessel, for example crucible furnaces, pot furnaces or kettles.

Such furnaces or kettles may be used for heating and melting metals, for heating and containing salts to heat treat components, or for heating fluidised powders for calcination or to act as a heat transfer medium. The heat may be supplied by various systems.

In the case of crucible furnaces, for example, heat may be supplied electrically such as by using an induction coil or radiating resistance elements to provide substantial uniform heating of the crucible. When oil or gas fired systems are used to supply the heat, it is known that a burner may be fitted at one position so that hot combustion product gases pass around the crucible and then flue out of the system at another position. In such systems, however, there will be changes in temperature around the crucible as result of the hot gases being cooled as they give up heat to the crucible. More even temperature distribution may be achieved by recirculating the gases a plurality of times around the crucible using, for example, jet entrainment techniques. Even so, the point nearest the discharge of the gases from the system can be expected to be at the lowest temperature.

In another known system for providing more uniform temperature distribution and applicable, for example, to large crucible furnaces or kettles used in galvanizing processes, a plurality of burners are disposed at two or more spaced positions around the crucible or kettle. Such burners are arranged to fire so that the hot gases from the burners flow in the same direction about the crucible or kettle.

According to the invention there is provided an apparatus for heating a vessel comprising an enclosure to surround said vessel, a reversing burner system having at least first and second burners for operating alternately as firing burners or as flues for hot combustion product gases, said enclosure being spaced from said vessel so that a flow path exists between the enclosure and vessel, said flow path being for receiving the hot combustion product gases discharged into the flow path from said firing burners, said flow path being adjacent to the exterior of the vessel and extending completely around said vessel for allowing circulation and re-circulation of the hot combustion product gases, and the first and second burners being in position for causing the hot combustion product gases from the first burner to flow in one direction along the flow path when the second burner is operating as a said flue in one cycle of operation of the burners and for causing the hot combustion product gases from the second burner to flow in the opposite direction along the flow path when the first burner is operating as a said flue in the alternate cycle of operation.

The apparatus may be provided with two burners operable as a pair or, alternately, may be provided with more than two burners, for example multiples of two in which case a plurality of burners are operable to cause the hot gases to flow in one direction along the flow path whilst a plurality of different burners are operable to cause the hot gases to flow in the opposite direction.

Advantageously, each burner has associated with it a respective heat regenerator or storage medium which is heated by the hot combustion product gases when the burner is operating in the flue mode and which heats combustion air prior to entering the burner when operating in the firing mode. The employment of heat regenerators or storage mediums, such as heat regenerative beds, for heat recovery can substantially improve the thermal efficiency of the apparatus. The beds may be formed by loose heat storage material contained between spaced porous ceramic plates which provide for distribution of the gases through the bed material.

In one embodiment of the apparatus the flow path may be generally circular and each burner may be arranged so as to fire substantially tangentially into the flow path when in the firing mode.

In another embodiment the flow, path may be generally square or rectangular and the burners may be arranged generally transverse to each other on respective adjoining sides of the flow path.

The flow path may in part be defined by a portion of the external surface of the vessel.

Conveniently, the vessel is removable from and/or tiltable with respect to the enclosure.

The apparatus may be in the form of a crucible furnace, or a kettle furnace.

The invention will now be further described, by way of example, with reference to the accompanying drawings, in which.

Figure 1:
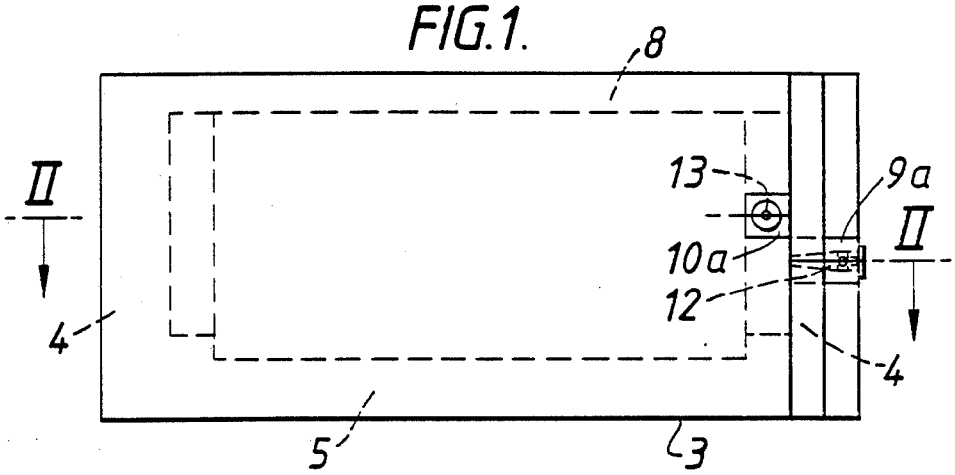
FIG. 1 is a schematic view from one side of one embodiment of apparatus formed according to the invention.
Figure 2:
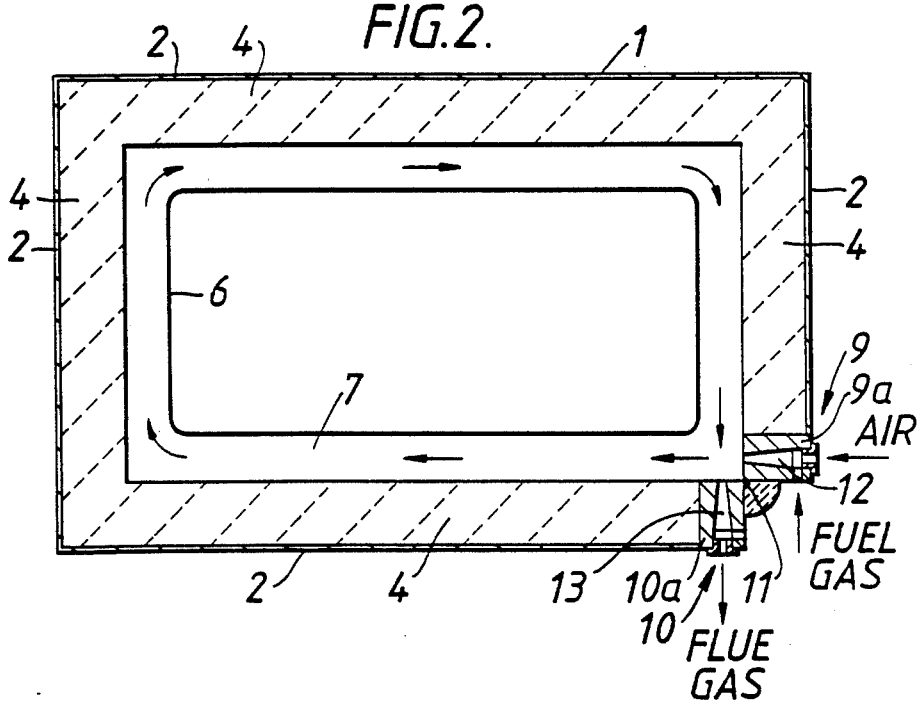
FIG. 2 is a sectional view of the apparatus taken on the line II—II in FIG. 1.

Referring to FIGS. 1 and 2 of the drawings, the apparatus is in the form of a kettle furnace. The apparatus comprises an outer casing 1, made for example of steel, whose walls 2 and base 3 are internally lined with thermally insulating material to form the side walls 4 and base 5 of an enclosure. Within this enclosure and spaced from the side walls 4 of the enclosure is a vessel in the form of a kettle 6 for containing, for example, molten zinc for galvanizing.

An annular flow path 7 along which hot combustion product gases can circulate is defined by the interior surfaces of the enclosure walls and by the spaced opposing exterior surfaces of the kettle itself. The bottom of the flow path 7 is defined by the insulating material on the base of the casing 1 which is recessed such that the base of the kettle is situated below the bottom of the flow path to limit the area of side walls in contact with the flow path. The top of the flow path is defined by insulating material 8 extending between the kettle 6 and the side walls 4. As viewed in FIG. 2, the flow path 7 is of generally rectangular shape.

The apparatus is provided with two gas fired reversing burners 9,10 comprising respective burner blocks *9a,10a* which are located in adjoining walls of the enclosure adjacent and on opposite sides of a corner 11 of the enclosure. The burner blocks are located in different but immediately adjacent horizontal planes as well as being displaced vertically with respect to each other. The burner blocks 9a,10a have central through bores or passages 12,13, respectively, and are arranged such that the latter are substantially at right angles to each other. The central through bores of each burner block alternately serve both to direct hot combustion product gases into the flow path 7 and lead the gases from the flow path.

When burner 9 is in the firing mode, burner 10 is in the flue mode and hot combustion product gases are caused to flow from burner 9 in one direction along and around the flow path 7 as shown by the direction of the arrows along the flow path in FIG. 2, until the gases exit via the central through bore 13, of burner block 10a. When the modes of the burners are reversed by means of an air/flue changeover valve (not shown) connected to the burners, the hot combustion product gases flow in the opposite direction around the flow path.

The sequential alternating or reversing of the firing/flueing modes of the burners enables more uniform or even heating around the kettle 6 and thus more uniform temperature distribution within the kettle.

Figure 3:
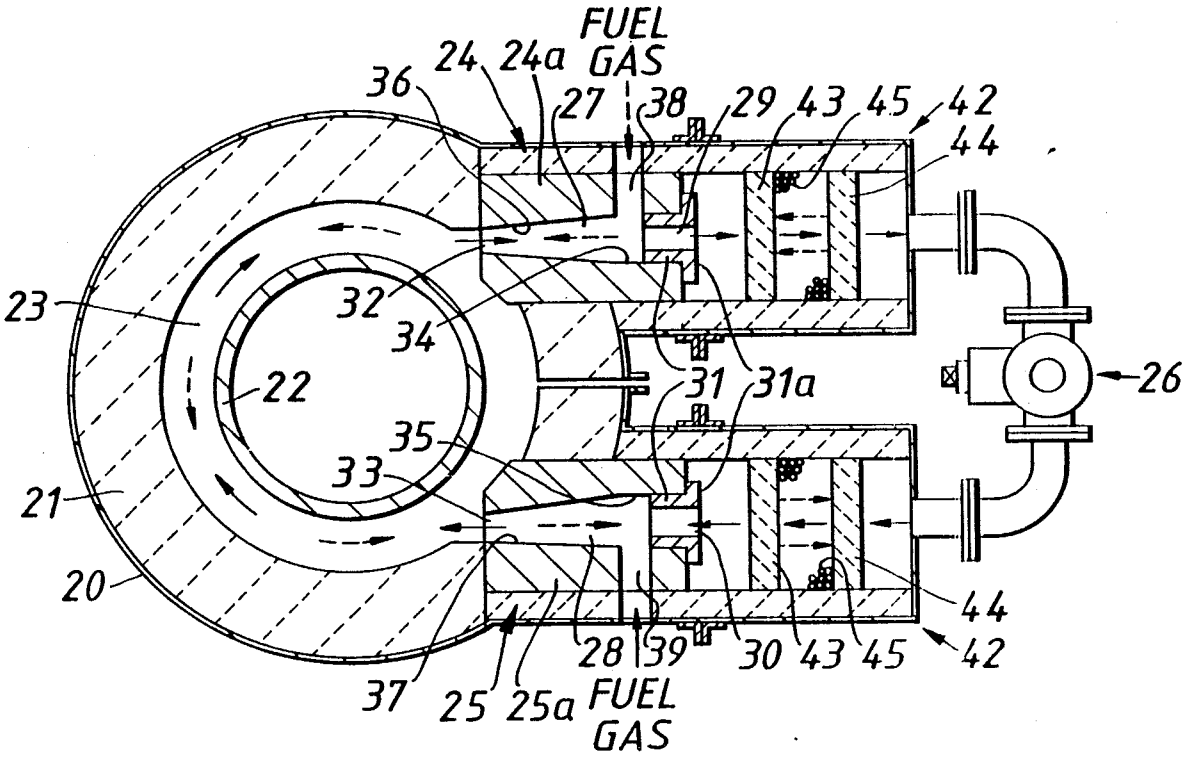
FIG. 3 is a sectional view taken on a horizontal plane, of another embodiment of apparatus formed according to the invention.
Figure 4:
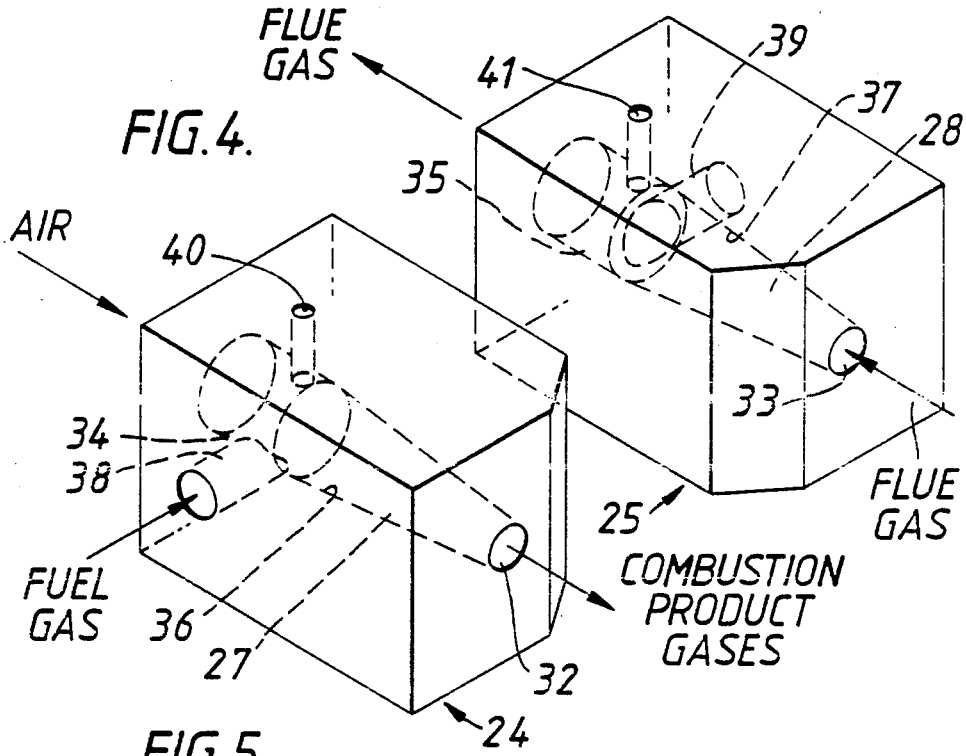
FIG. 4 shows schematically perspective views of the burner blocks in the apparatus in FIG. 3.
Figure 5:
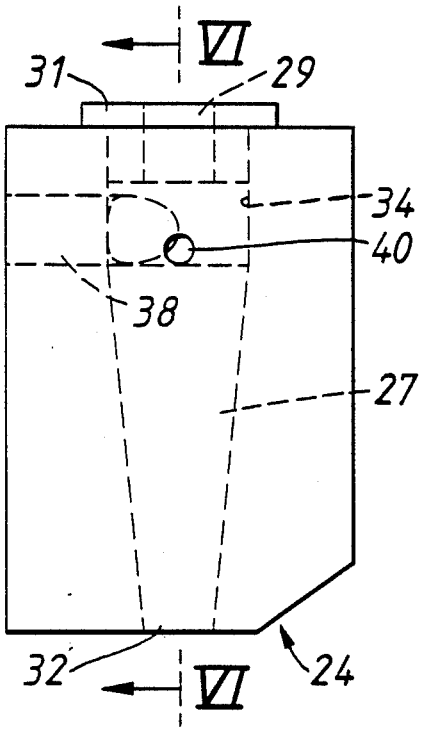
FIG. 5 is a plan view from above of the left hand burner block as shown in FIG. 4 fitted with an air orifice insert.
Figure 6:
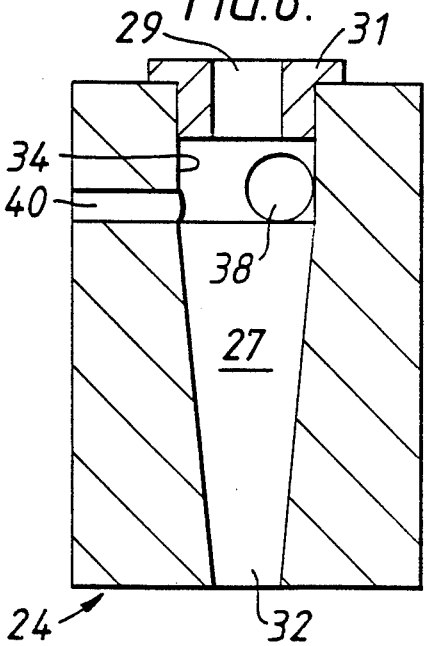
FIG. 6 is a sectional view of the burner block shown in FIG. 5 taken on the line VI—VI.

With reference to FIGS. 3 to 5, the apparatus is in the form of a crucible furnace and comprises an enclosure comprising an outer casing 20 lined internally with thermally insulating material, such as stack bonded ceramic fibre, to form an enclosure wall 21, and a vessel or crucible 22 which is spaced from the enclosure wall and defines therewith a generally circular flow path 23 for hot combustion product gases around the crucible. A removable insulated cover can extend, over the flow path 23, from the wall 21 to the crucible 22. Mounted in the enclosure wall is a burner system which comprises pair of burners 24,25 spaced apart in a horizontal plane and operable sequentially in alternating firing and flue modes via air/flue changeover valve system 26. The method of operating the two burners for alternate firing and flueing may be similar to that described in published British Patent Application No. 2136553A.

The burners 24,25 comprise refractory burner blocks 24a,25a, having central through bores 27,28. The refractory burner blocks are arranged such that when the burners 24,25 are in their firing modes they fire through the central through bores 27,28 substantially tangentially into the circular flow path.

The openings of the central through bores 27,28 of the burner blocks 24a,25a remote from the crucible are provided with annular, straight bore inserts 31 so that openings 29,30 into the blocks are of similar diameter to the openings 32,33 in the blocks at the opposite ends of the bores 27,28. The axis of the straight bore of each insert 31 is substantially coaxial with the axis of the respective central through bore. The inserts 31 each have a flanged portion 31a which abuts the end surface to the respective burner block 24a or 25a remote from the crucible 22. The inserts are refined in the bores 27,28 by interference fit.

A region 34,35 of each central through bore 27,28 just inwardly of the inserts 31 is of larger diameter to permit mixing and some combustion of the fuel gas with air when the respective burner is in the firing mode. From the larger diameter regions 34,35 the central through bores taper as at 36,37 in a direction towards the crucible to the openings 32,33. Each burner block 24a,25a has an inlet bore 38,39 for fuel gas disposed both at right angles and tangentially to the larger diameter regions 34,35 for introducing fuel gas into the burner. Each burner block 24a,25a also has bores 40,41 which are disposed radially with respect to and communicate with the larger diameter regions 34,35 and provide for flame detection access.

Connected at one end to each burner block 24a,25a is a respective heat regenerator unit 42, each comprising spaced apart porous ceramic plates 43,44 containing there between a bed of heat storage material 45. The purpose of the porous plates is to distribute incoming air or outgoing flue gases generally uniformly to and from the bed. The air/flue changeover valve system 26 is connected to the free ends of the regenerator units. Each burner 24 or 25 and associated regenerator unit 42 may together form a single overall unit contained in single integral rigid modular housing so as to be replaceable as one unit.

During operation of the apparatus, with burner 25 in the firing mode, air via the valve 26 passes through, and is pre-heated in, the associated regenerator unit 42, and then passes through burner block insert 31 into the larger diameter region 35 of the burner block 25a. Fuel gas for the burner 25 is introduced into the larger diameter region 35 via the fuel gas inlet 39 in the burner block 25a. The hot combustion product gases are emitted from the opening 33 in the burner block 25a generally tangentially into he flow path 23 and travel in the direction of the solid line arrows around the flow path about the crucible 22 thereby to heat up the latter. The gases exit from the system via opening 32 in burner block 24a of burner 24 which is operating in the flue mode. As can be appreciated, the flue gases pass through and heat up the bed material 45 in the regenerator unit 42 connected to burner 24, preparatory to the bed heating up incoming air entering burner 24 when the modes of the two burners are reversed. In such reversed modes the paths followed by the fuel gas, air and hot combustion product gases are shown by the broken line arrows in FIG. 3.

In order to control more closely the temperature of the crucible 22, it may be arranged for the combustion air or gas to be admitted at a substantially constant rate into the system during each cycle but for the fuel gas to be introduced for only a proportion of the time each burner is in the firing mode.

The alternating firing cycles are preferably in the time range 30 sec. to 5 minutes. A more preferred firing time is about 2 minutes. The latter time in particular has led to improved heat distribution around the crucible. The improvement in temperature distribution is considered advantageous in providing an increase in thermal efficiency, improved crucible life and a reduction in heat loss through the insulated case 20,21.

Whilst particular embodiments of the invention have been described above, it will be understood that various modifications may be made without departing from the scope of the invention. For example, multiple pairs of burner systems may be suitably arranged in the apparatus.

We claim:

1. Apparatus for heating a vessel comprising an enclosure to surround said vessel, a reversing burner system having at least first and second burners for operating alternately as firing burners or as flues for hot combustion product gases, said enclosure being spaced from said vessel so that a flow path exists between the enclosure and vessel, said flow path being for receiving the hot combustion product gases discharged into the flow path from said firing burners, said flow path being adjacent to the exterior of the vessel and extending completely around said vessel for allowing circulation and re-circulation of the hot combustion product gases, and the first and second burners being in positions for causing the hot combustion product gases from the first burner to flow in one direction along the flow path when the second burner is operating as a said flue in one cycle of operation of the burners and for causing the hot combustion product gases from the second burner to flow in the opposite direction along the flow path when the first burner is operating as a said flue in the alternate cycle of operation.

2. Apparatus as claimed in claim 1, in which a respective heat regenerator is associated with each said burner, and a said regenerator is for heating by the hot combustion product gases when the associated burner is operating in the flue mode and which heated regenerator is for heating combustion air prior to entering the associated burner when that burner is operating in the firing mode.

3. Apparatus as claimed in claim 1, in which the flow path is generally circular.

4. Apparatus as claimed in claim 3, in which each said burner is arranged for firing its hot combustion product gases generally tangentially with respect to said circular flow path.

5. Apparatus as claimed in claim 1, in which said flow path is generally rectangular.

6. Apparatus as claimed in claim 1, in which said flow path is generally square.

7. Apparatus as claimed in claim 5, in which the first and second burners are arranged transverse to each other on respective adjoining sides of said rectangular flow path.

8. Apparatus as claimed in claim 6, in which the first and second burners are arranged transverse to each other on respective adjoining sides of said square flow path.

9. Apparatus as claimed in claim 1, in which the burners are situated in different horizontal planes an are vertically offset with respect to each other.

10. Apparatus as claimed in claim 1, in which said flow path is in part defined by an external surface of said vessel.

11. Apparatus as claimed in claim 1, in which said vessel is removable from the enclosure.

12. Apparatus as claimed in claim 1, in which said vessel is tiltable with respect to the enclosure.

13. Apparatus as claimed in claim 1, in which the apparatus is a crucible furnace and said vessel is a crucible.

14. Apparatus as claimed in claim 1, in which the apparatus is a kettle furnace and said vessel is a kettle.

* * * * *